US011950659B2

(12) United States Patent
Oroszi et al.

(10) Patent No.: US 11,950,659 B2
(45) **Date of Patent: *Apr. 9, 2024**

(54) SPORTS SHOE WITH A STRIPED PATTERN FACILITATING BALL HANDLING

(71) Applicants: László Oroszi, Vál (HU); Mihály István Lantos, Budapest (HU); István Márton, Budaörs (HU); Béla Tóth Balogh, Budapest (HU); Miklós Koszta, Budapest (HU)

(72) Inventors: László Oroszi, Val (HU); Mihály István Lantos, Budapest (HU)

( * ) Notice: Subject to any disclaimer, the term of this patent is extended or adjusted under 35 U.S.C. 154(b) by 251 days.

This patent is subject to a terminal disclaimer.

(21) Appl. No.: 17/055,760

(22) PCT Filed: May 9, 2019

(86) PCT No.: PCT/HU2019/050021

§ 371 (c)(1),
(2) Date: Nov. 16, 2020

(87) PCT Pub. No.: WO2019/220156

PCT Pub. Date: Nov. 21, 2019

(65) Prior Publication Data

US 2021/0204640 A1 Jul. 8, 2021

(30) Foreign Application Priority Data

May 16, 2018 (HU) ..... P1800162

(51) Int. Cl.
*A43B 5/02* (2006.01)
*A43B 23/02* (2006.01)

(52) U.S. Cl.
CPC ..... *A43B 5/025* (2013.01); *A43B 23/0235* (2013.01)

(58) Field of Classification Search
CPC ..... A43B 5/00–008; A43B 5/02; A43B 5/025; A43B 5/04–0498; A43B 5/06;
(Continued)

(56) References Cited

U.S. PATENT DOCUMENTS 7,155,846 B2 * 1/2007 Alfaro ..... A43B 1/0027 36/45
7,487,605 B2 * 2/2009 Hatzilias ..... A43B 5/02 36/133

(Continued)

*Primary Examiner* — Bao-Thieu L Nguyen
(74) *Attorney, Agent, or Firm* — Handal & Morofsky LLC; Anthony H. Handal

(57) ABSTRACT

Sports shoe with a striped pattern facilitating ball handling, having an upper and a sole, wherein the surface of the upper of the sports shoe is divided into a plurality of shooting zones, namely at least into a nose zone (14), an inner shooting zone (15) and an outer shooting zone (16) and at least one of the shooting zones (14, 15, 16) comprises a plurality of ball directing stripes (20) arranged side-by-side beside and being spaced from each other and the directing stripes extend out from the surface of the upper that constitutes a basic surface (17), the directing stripes (20) have elevated outer surfaces (18) with increased grip to the ball compared to the grip of the basic surface (17), wherein the spaces between said directing stripes (20) constitute respective ball directing channels (21) and the at least one shooting zone comprises a group of at least four directing stripes (20) and a group of at least three directing channels (21) between the directing stripes, and out of these two groups the width of the directing stripes and/or the directing channels of at least one group continuously changes along its length, wherein the width of the directing stripes is at least 3 mm and at most 20 mm and their height is at least 0.4 mm, and the width of said directing channels is at most 20 mm, an the pattern comprises said groups.

20 Claims, 4 Drawing Sheets

(58) Field of Classification Search
CPC .... A43B 5/08; A43B 5/10; A43B 5/12; A43B 5/14; A43B 5/145; A43B 5/16–1691; A43B 5/18; A43B 5/185; A43B 23/0235
See application file for complete search history.

(56) References Cited

U.S. PATENT DOCUMENTS

| | | | | |
|---|---|---|---|---|
| 7,562,471 | B2 * | 7/2009 | Minami | A43B 5/025 36/133 |
| 7,637,032 | B2 * | 12/2009 | Sokolowski | A43B 23/0275 36/9 R |
| 8,356,429 | B2 * | 1/2013 | Eder | A43B 13/223 36/114 |
| 8,943,711 | B2 * | 2/2015 | Hooper | A43B 5/025 36/133 |
| 9,038,288 | B2 * | 5/2015 | Droege | A43B 5/025 36/133 |
| 9,380,834 | B2 * | 7/2016 | Rushbrook | A43B 23/0215 |
| D791,450 | S * | 7/2017 | Birkinhead | D2/902 |
| 10,238,171 | B2 * | 3/2019 | Mokos | A43B 23/021 |
| 10,624,418 | B2 * | 4/2020 | Mokos | A43B 23/042 |
| 11,457,689 | B2 * | 10/2022 | Oroszi | A43B 23/0235 |
| 11,517,069 | B2 * | 12/2022 | Minami | A43B 23/0235 |
| 2003/0167658 | A1 * | 9/2003 | Davis | A43C 13/14 36/128 |
| 2004/0088888 | A1 * | 5/2004 | Johnston | A43B 5/025 36/133 |
| 2005/0016023 | A1 * | 1/2005 | Burris | B29D 35/146 36/55 |
| 2006/0048413 | A1 * | 3/2006 | Sokolowski | A43B 23/0235 36/45 |
| 2006/0117600 | A1 * | 6/2006 | Greene | A43B 13/141 36/9 R |
| 2007/0044346 | A1 * | 3/2007 | Ungari | A43B 23/0235 36/136 |
| 2009/0007457 | A1 * | 1/2009 | Skirrow | A41D 19/01558 36/114 |
| 2010/0077637 | A1 * | 4/2010 | Hatzilias | A43B 3/0042 36/133 |
| 2010/0299967 | A1 * | 12/2010 | Atsumi | A43B 5/02 36/133 |
| 2011/0247240 | A1 * | 10/2011 | Eder | A43B 1/0009 36/133 |
| 2011/0258883 | A1 * | 10/2011 | Eder | A43B 5/02 36/133 |
| 2012/0233888 | A1 * | 9/2012 | Baker | A43B 5/025 36/133 |
| 2013/0074374 | A1 * | 3/2013 | Droege | A43B 7/24 36/133 |
| 2013/0125417 | A1 * | 5/2013 | Minami | A43B 23/0235 36/83 |
| 2015/0201705 | A1 * | 7/2015 | Doremus | A43B 5/025 2/69 |
| 2016/0095389 | A1 * | 4/2016 | Minami | A43B 7/146 36/45 |
| 2016/0136869 | A1 * | 5/2016 | Iovu | B29C 51/14 36/83 |
| 2016/0143395 | A1 * | 5/2016 | Van Atta | A43B 23/028 36/48 |
| 2016/0227881 | A1 * | 8/2016 | Beers | A43B 23/0265 |
| 2017/0208896 | A1 * | 7/2017 | Mokos | A43B 23/0235 |
| 2017/0208897 | A1 * | 7/2017 | Mokos | A43B 13/226 |
| 2017/0238658 | A1 * | 8/2017 | Gu | A43B 23/0295 |
| 2017/0348935 | A1 * | 12/2017 | Leimer | A43B 23/026 |
| 2017/0360140 | A1 * | 12/2017 | Siegismund | A43B 23/027 |
| 2018/0103728 | A1 * | 4/2018 | Koo | B41M 3/00 |
| 2018/0153257 | A1 * | 6/2018 | Chang | A43C 11/1493 |
| 2019/0053569 | A1 * | 2/2019 | Johnson | A43B 13/141 |
| 2019/0106551 | A1 * | 4/2019 | Fischer | C08F 2/56 |
| 2019/0328075 | A1 * | 10/2019 | Poulsen | D04B 1/12 |
| 2020/0015542 | A1 * | 1/2020 | Hsu | A43B 23/022 |
| 2020/0196707 | A1 * | 6/2020 | Toronjo | B32B 37/12 |
| 2020/0214390 | A1 * | 7/2020 | Mokos | A43B 23/021 |
| 2021/0100315 | A1 * | 4/2021 | Nguyen | A43B 23/0255 |
| 2021/0204640 | A1 * | 7/2021 | Oroszi | A43B 5/025 |

* cited by examiner

SPORTS SHOE WITH A STRIPED PATTERN FACILITATING BALL HANDLING

The invention relates to a sports shoe with a striped pattern facilitating ball handling, wherein the surface of the upper of the sports shoe is divided into a plurality of shooting zones, and the pattern is provided on at least one of said zones, and comprises directing stripes arranged adjacent to each other that are extending out of the base surface of the upper to a predetermined extent and the stripes have outer surfaces having increased grip to the ball relative to the grip of the base surface of the upper, and directing channels are formed between the stripes.

The design of the outer surface of sports shoes that can provide optimum ball handling is a task known for a long time, and there are several ways how this task can be solved.

In my European patent EP 0948269 on the shooting surface of the sport shoe the use of ribbing was suggested for improving ball handling wherein the ribs were arranged in different directions. In case the ball arrives normal to the direction of the ribs, then by utilizing the law of reflections the edges of the ribs forwarded the ball towards the target with high force and spin. To that end the ribs had to be arranged so that possibly on all surface parts the direction of the ribs had to extend normal to the required shooting direction of the given surface part. This condition cannot be fully met because the shoe upper does not have a single surface part where the player wishes to kick the ball only into a single direction. A further problem arose from the hard design of the upper of the shoe because the ribs were provided on a thin rubber sheet and these cannot follow the shape of the bare foot as exactly and accurately as the thin leathers and leatherettes used nowadays.

A similarly designed ribbing was provided on the sports shoes sold under the commercial name "Predator Mania®" of the German company Adidas AG, but here the ribbing was provided only on the inner shooting zone of the shoes.

In the document US 2009/0009457 for improving the grip between the shoe surface and the ball numerous solutions were suggested and described a number of different plastic compounds and compositions that provide increased grip to the ball both under dry and wet conditions compared to customary leather or plastic shoe materials. The publication has suggested using self adhesive coatings that have outer surfaces as suggested.

In the document WO2014/016629 solutions were suggested for improving the grip between the shoe surface and the ball by using uncoated rubber granulates, and it was suggested that such grip-improving layers be provided on spaced zones of the surface of the upper of the shoe, and the respective zones should be provided to ensure optimum targeting and ball directing effects. The document has also suggested the utilization of the edges of the coated zones for directing the ball and it has also suggested the use of an appropriate ribbing.

That publication was, however, silent about the actual ways how these objectives can be reached by the arrangement of the surface parts having increased grip to the ball, and suggested only that experiments should be carried out and everyone has to find his/her optimum solution.

The object of the invention is to satisfy the above outlined needs in a more perfect way and to provide a surface pattern on the surface of the sports shoes that can substantially increase the accuracy of targeting, the force of shooting and improve ball handling and takes into account that the ball handling and shooting tasks differ in the respective zones of the upper of the shoes and even within a single zone a possibility should be provided to the player that the ball should take the path in line with his intentions.

With the invention a sports shoe has been provided with a striped pattern facilitating ball handling that has an upper and a sole, wherein the surface of the upper of the sports shoe is divided into a plurality of shooting zones, namely at least into a nose zone, an inner shooting zone and an outer shooting zone and at least one of the shooting zones comprises a plurality of ball directing stripes arranged side-by-side beside and being spaced from each other and the directing stripes extend out from the surface of the upper that constitutes a basic surface, the directing stripes have elevated outer surfaces with increased grip to the ball compared to the grip of the basic surface wherein the spaces between the directing stripes constitute respective ball directing channels and the at least one shooting zone comprises a group of at least four directing stripes and a group of at least three directing channels between the directing stripes, and out of these two groups the width of the directing stripes and/or the directing channels of at least one group continuously changes along its length, wherein the width of the directing stripes is at least 3 mm and at most 20 mm and their height is at least 0.4 mm, and the width of the directing channels is at most 20 mm, and the pattern comprises said groups.

In a preferred embodiment the change of the width of the directing stripes in a group takes place in one direction along their length i.e. it increases or decreases.

It can be preferable if the width of the directing channels in a group is constant.

At an alternative embodiment the width of the directing channels changes in the same direction as the width of the directing stripes between them.

In a different embodiment the width of the directing channels changes in the opposite direction as the width of the directing stripes between them.

It is preferred if the edges of the directing stripes are curved in the space and when being spread in a plane they are arced in a direction.

It can be preferred if the edges of the directing stripes have bidirectional curvatures with an inflexion in a central part.

At a further embodiment in a group the direction of the change of the width of the directing stripes gets reversed in a central region.

In a further alternative embodiment the change of the width of the directing channels gets also reversed but in opposite direction than the change of the width of the directing stripes.

It is preferred if in a pair of the groups the directing stripes and the directing channels extend through a plurality of zones.

The increased grip to the ball can be realized if the outer surface of the directing stripes comprises uncoated particulates of a flexible, resilient material preferably of rubber wherein the average particulate size is between about 0.4 and 1 mm.

Better targeting can be provided if at least few of the directing stripes comprise a ribbing on its outer surface.

A preferred embodiment comprises directing stripes that extend till the edge of the sole and cover at least a portion of the edge.

In an embodiment the directing stripes in the rear portion of the shoe have height that increases in rearward direction.

In a preferred embodiment the shoe comprises a lace opening, and the height of at least a few of the directing stripes that extend close to the lace opening have height increasing in the direction of said lace opening.

The invention will now be described in connection with preferred embodiments thereof, wherein reference will be made to the accompanying drawings. In the drawing.

Figure 3:
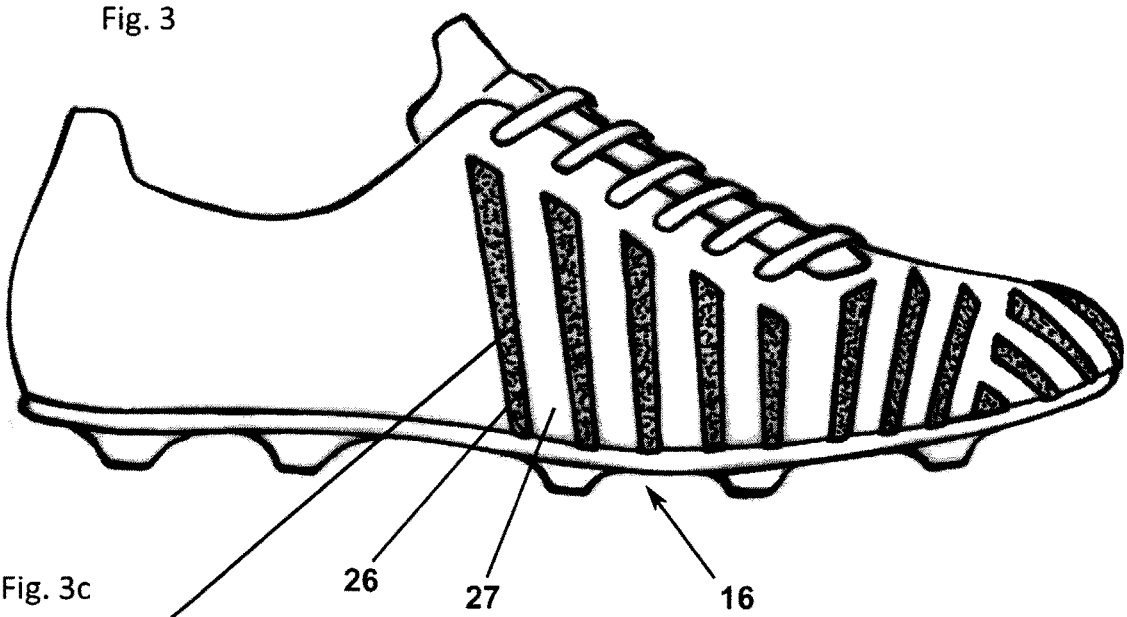
FIG. 3 shows the side view of the outer part of the sports shoe shown in FIG. 1.
Figure 3C:
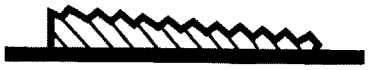
Figure 3A:
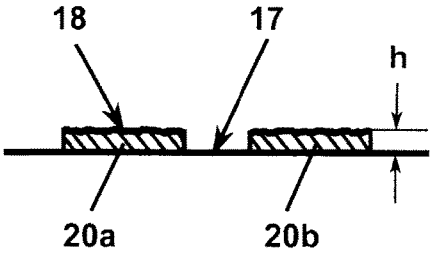
Figure 3B:
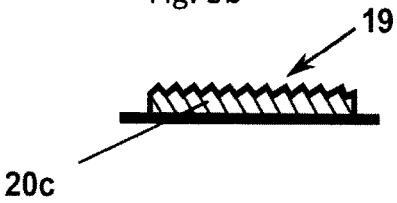
Figure 3D:
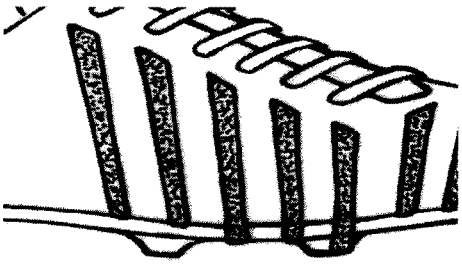
Figure 4:
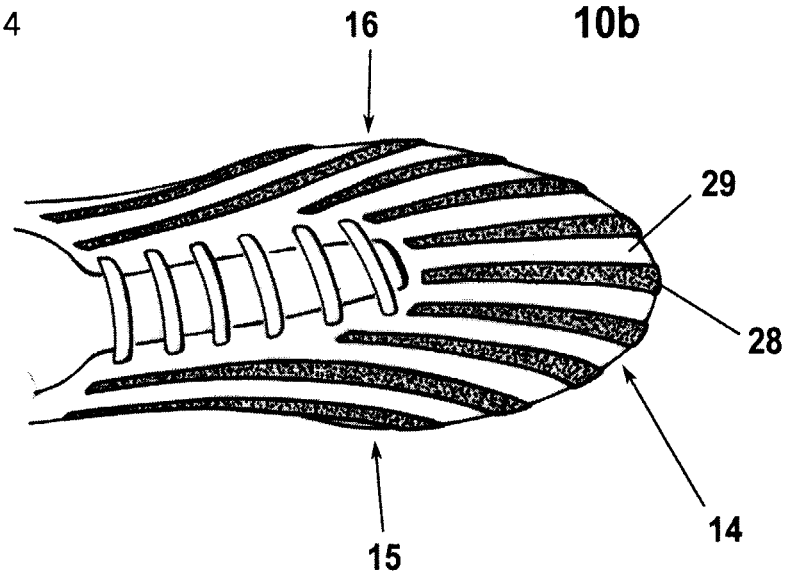
Figure 5:
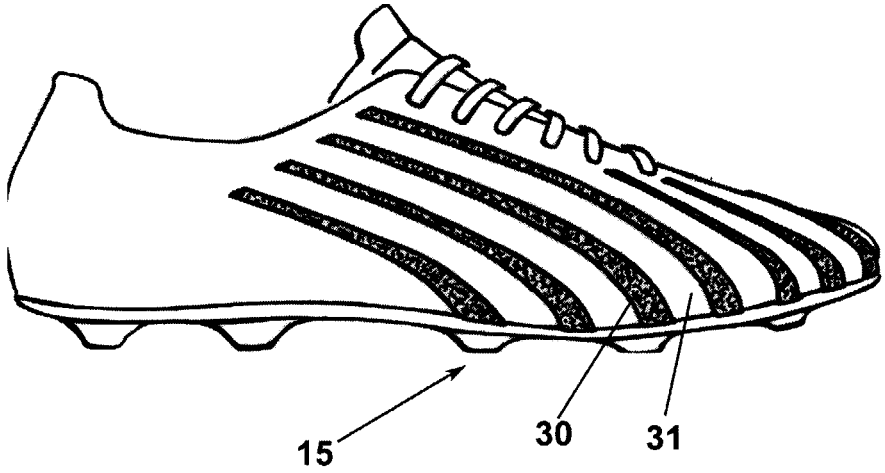
Figure 6:
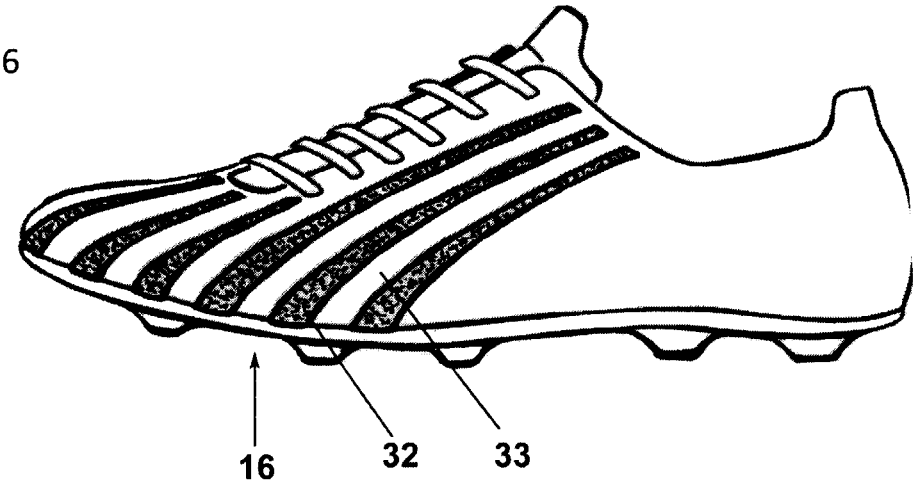
Figure 7:
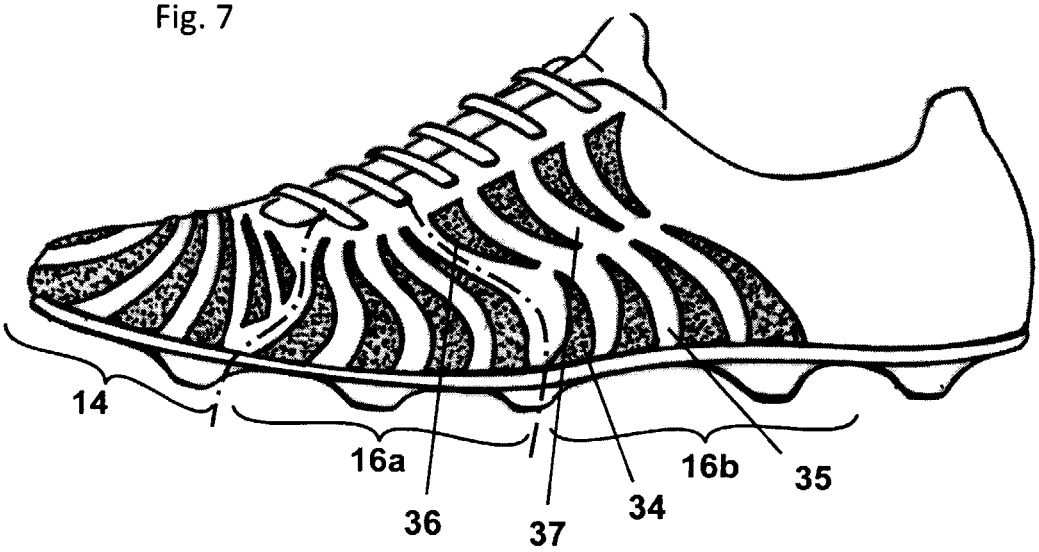

FIG. 3*a* is an enlarged sectional detail taken from the directing stripes;

FIG. 3*b* is a section similar to FIG. 3*a* in case of an embodiment with a ribbing;

FIG. 3*c* is a longitudinal sectional detail of the rearmost directing stripe 26 that illustrates the change of thickness;

FIG. 3*d* shows a detail from the side view of FIG. 3 wherein the bottom of the directing stripe 26 extends in downward direction and covers the edge of the sole;

FIG. 4 shows the top view of a right shoe having a further type of pattern;

FIG. 5 shows the side view of the inner part of the shoe shown in FIG. 4;

FIG. 6 is the side view of the inner part of the shoe shown in FIG. 4;

FIG. 7 shows the side view of a left shoe provided with a different pattern; and FIGS. 8 to 12 provide examples on the design of different directing stripes and directing channels between them.

Figure 1:
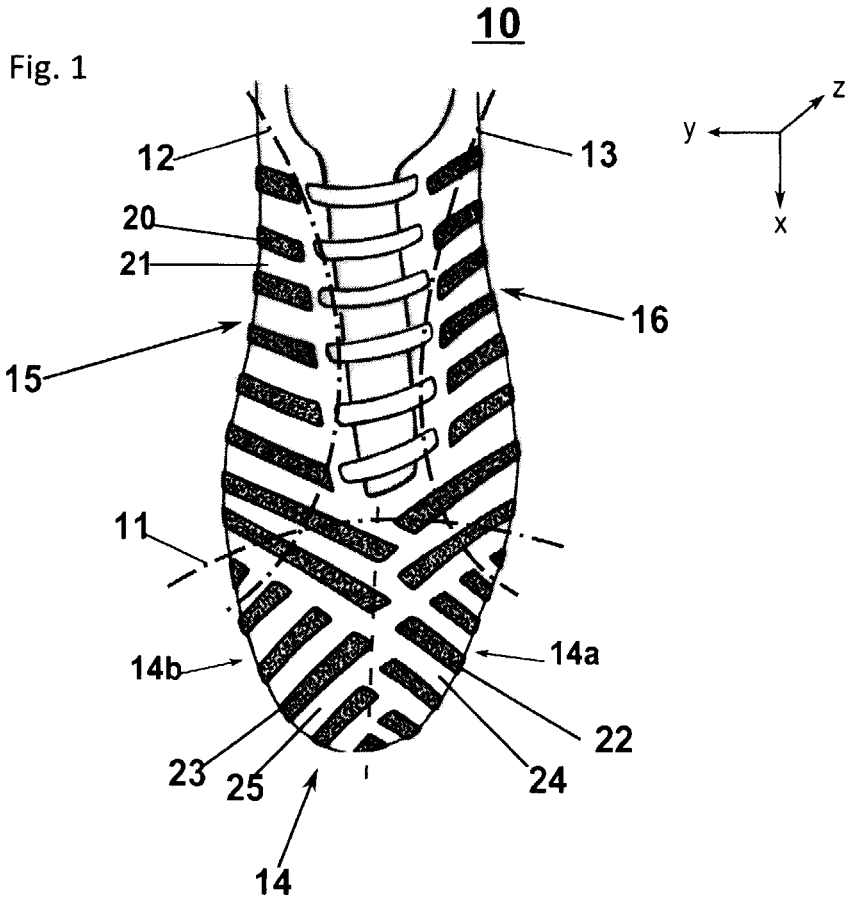
FIG. 1 shows the top view of a left shoe provided with a pattern according to the invention.

FIG. 1 shows the top view of the first embodiment of a sports shoe 10 according to the invention designed for the left foot of a player and provided with a striped pattern with narrowing or widening stripes. For the sake of simplicity the invention will be described in connection with uses for soccer games but similar principles are true in case of use in futsal, footgolf or even in American football games or in any other uses when a player kicks, passes or handles a ball from any reason.

From the point of view of ball handling the surface of the shoe used for shooting can be divided into a plurality of separate zones between which there can be small overlaps and the boundaries of such zones have been schematically illustrated in FIG. 1 by dash-dot lines 11, 12 and 13. In front of the curved, slightly horseshoe-shaped line 11 the area towards the nose of the shoe designates nose zone 14. The dash-dot line 12 is the boundary of an inner shooting zone 15 and the line 13 is the boundary of outer shooting zone 18 of the shoe. On the heel zone of the exemplary sports shoe 10 no pattern was made, however, there can be uses in which there can be sense to provide patterns also on the heel zone. The boundaries of the respective zones are not sharply separated as the zones transit into each other in a smooth transition having no sharp boundaries. The players know well and also have experienced how to receive and kick the ball in possible situations during the game. From the point of view of a finer ball handling the mentioned zones can be divided into further parts e.g. frontal, central or rear inner (or outer) zones. In FIG. 1 a coordinate system y, x, z has been illustrated because the players can turn and incline their feet (and their shoes) in all directions in the space, therefore the different curved surfaces of the zones can contact the ball in differing angles and forward it in accordance with the intention of the player. The axis x designates the longitudinal direction of the shoe, the direction y the transverse direction and the direction z the direction normal to the plane of the sole.

On the surface of the upper of the sports shoe 10 special directing stripes 20 are provided which are spaced from each other, and the spaces have often by varying width, which will be referred to in the following as diverting channels 21, and their shapes as well as the shapes and arrangement of the directing stripes 20 follow certain rules. The shape of the directing stripes 20 is defined by two boundary lines that can be straight or curved that follow the spatial curvature of the upper of the shoe, and in spread view it resembles to a strip having narrowing width in a direction. The arrangement of the directing stripes 20 provides the directing channels 21 between adjacent stripes which can have constant width or a width narrowing in a direction. It should be noted that the directing channels formed between the directing stripes are spatial tracks along which the ball arriving there is forced to follow the direction of the contacted directing channel.

The nose zone 14 of the sports shoe shown in FIG. 1 is divided symmetrically to a central axis to a left section 14*a* and a right section 14*b*, on which directing stripes 22, 23 are provided which have straight boundary lines and their width increases slightly from the edge of the shoe towards the centre, and the direction of their centre lines closes an angle with the transversal direction y of the shoe between about 15° to 20° and they are directed from the edges inside and rearward. In the top view of FIG. 1 the centre lines of the left and right directing stripes 22, 23 appear parallel to each other. This is so because the directing channels 24, 25 formed between the directing stripes 22, 23 narrow from the edge towards the centre, and the extent of this narrowing corresponds to the widening of the directing stripes 22, 23. Such a design or the nose zone 14 is preferred for players who receive the ball arriving from frontal direction by their foot inclined slightly to the left or right, and when the ball contacts the rearward narrowing directing channels 24 or 25, then the edges of the directing channels lead the ball to the directing stripes 22, 23 that define them, and with a good grip thereon the ball will fly away in a flat curve to the direction contemplated by the player.

The directing stripes 20 swell out from the basic surface of the shoe in a predetermined height and their upper surfaces are parallel to the surface of the upper underneath, and these upper surfaces of the stripes have increased grip to the ball. The height can depend on the size of the shoe and its main role of use, on the needs of the player, on the zone where it is arranged and also on the position taken in the zone. The height is between about 0.4 and 3 mm, preferably between about 0.6 to 1.5 mm and more preferred is the height range between 0.8 and 1.2 mm. The height of the directing stripes 20 from the upper surface of the shoe determines the height of the respective edges, and owing to their height and strength these edges are able to direct the ball when getting into contact therewith.

Although the presence of the edges tries to divert the ball arriving there along the concerned directing channel, the contact area between the shoe and the ball is sufficiently large so that the ball will predominantly contact and get reflected by the outer surfaces of the stripes which belong to these edges. This outer surface should be preferably a grainy surface wherein the grains or granules forming the surface have irregular shapes and made of a resilient material (e.g. from rubber) and they are fixed to the underlying surfaces by adhesive bonding. Such structures are described in the previously referred document WO 2014/016629. Although it is preferred if the grainy structure is applied in several layers but from the point of view of the present invention this is not a mandatory condition. The directing stripes 20 can be made e.g. by the cutting of prefabricated sheets having the required thickness and comprising one or more layers of granules into the required shape, and such sheets can have a self adhesive bottom surface they can be positioned on the designated area of the upper of the shoe. This can happen during manufacture of the shoe or later on the surface of the ready-made shoes. In that case on the surface of the semi finished sheets (before the cutting of the directing stripes) a grainy surface can be provided that has size, colour and other properties which meet the requirements of use in the given zones. The selection of the sheets can also happen by choosing the required type out of a plurality of prefabricated samples. Instead of using the preferred grainy surface structure other surface types can also be used if they provide appropriate grip to the ball. US publication 2009/0007457 lists a high number of plastic materials which have such increased grip.

The directing stripes 20 can also be made during the manufacture of the upper of the shoes when the material of the upper is still in a shape spread in a plane. Under such phase of the production there are several ways how the required arrangement of stripes that have proper shapes, height and other properties can be realized. It should be noted when the upper is pulled over the last and a spatial form is taken, in the material distortions, tensions and material extensions take place, and if the directing stripes 20 are provided before this manufacturing step it should be ensured that the pattern composed by the directing stripes 20 and channels 21 takes the required shape following such distortions i.e. on the final curved spatial surface of the manufactured shoe.

Figure 2:
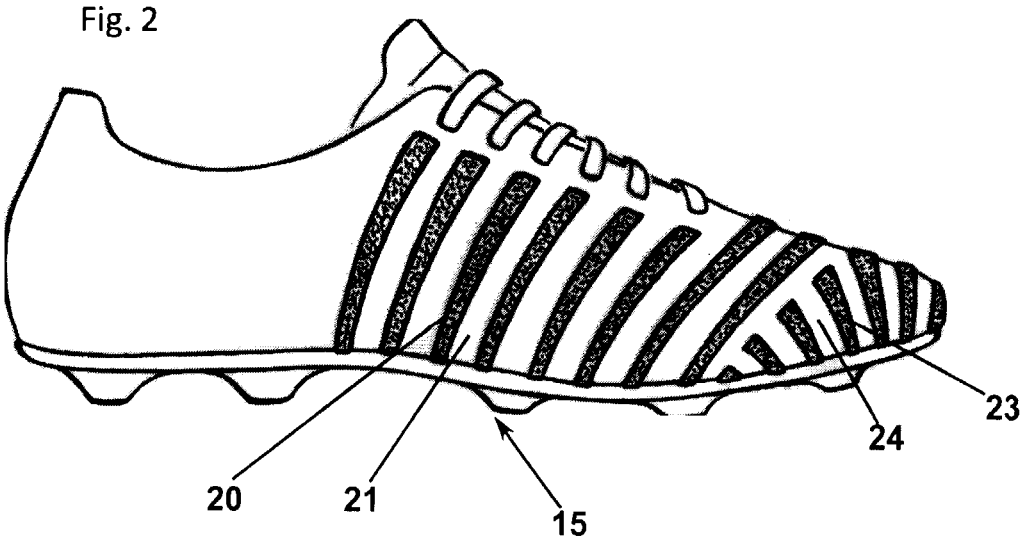
FIG. 2 shows the side view of the sports shoe shown in FIG. 1.

Referring now to FIG. 2 which is a side view of the inner side of the sports shoe 10 shown in FIG. 1 in which the directing stripes 20 of the inner shooting zone 15 and the directing channels 21 formed between them are shown in a better way. The directing stripes 20 have slightly forwardly inclined curved shape and their width continuously increases from the edge region towards the interior of the zone. The width of the directing channels 21 formed between these directing stripes 20 changes in opposite direction they are the narrowest at the top and inside and become wider in downward and outward direction. Such a design makes it possible that the respective centre lines of the trapezoidal shaped directing stripes 20 have only a slight forward inclination. This can be well observed in FIG. 2 as the stripes are seen from the heel portion to forward direction. This slightly forwardly inclined shape of the directing stripes 20 makes the path of the ball flatter, whereby the ball can fly taking a flat arced path towards the gate or in case of a pass to the target player.

FIG. 3 shows the outer side of the same sports shoe. It can be seen that the shape of the directing stripes 26 in the outer shooting zone 16 is substantially different from that of the directing stripes 20 provided in the inner shooting zone 15 shown in FIG. 2 as they have substantially straight boundaries and the width of the directing channels 27 formed between them is the same. It is the consequence of the constant channel width why edges of the rearmost directing stripe which is closest to the heel part of the shoe is slightly tilted in rearward direction with respect to the vertical direction z as we proceed along the stripes in forward direction, the upwardly widening directing stripes 26 gradually turn and get inclined in forward direction, wherein the third or fourth directing stripe from behind is practically in the normal direction z which is normal to the sole, and the direction of the stripes thereafter have a slight forward inclination. The inclination in rearward direction causes the ball to take an elevated path i.e. to proceed upwards and forward, and the inclination in forward direction decreases the upward angle of the path of ball i.e. makes it flatter.

When the effects of the patterns provided on the shoe surface are mentioned, then the differences relative to the usual shoe designs are enhanced. The skill and technique of the player has high role in directing the ball, it is only emphasized here how and in which way the design of the shoe can facilitate this role and skill.

FIG. 3*a* shows an enlarged sectional view of two adjacent directing stripes 20*a* and 20*b* and the figure shows the base surface 17 of the shoe the height h of the two directing stripes 20*a* and the edges constituted by the sides of the stripes, and the outer (upper) surface 18 of the directing stripes 20*a*, 20*b* which, as mentioned earlier, have preferably a grainy structure and has an increased grip to the ball. FIG. 3*b* shows the ribbed design (with grooves between the ribs) of the outer surface of a directing stripe 20*c* which means that on the grainy outer surface 18 of the directing stripe 20*c* a ribbing 19 is provided wherein the ribs extend preferably parallel to the transverse direction of the directing stripe 20*c*. The ribs of the ribbing 19 are sufficiently wide and deep for diverting the arriving ball to a direction substantially normal to or closely normal to the edges of the ribbing 19. The size of such width and depth are roughly between about 0.5 and 1.5 mm. The presence of the ribbing 19 increases the directing effect but its use in not indispensable, and there is no need to provide a ribbing 19 on all directing stripes and the direction of the ribbing 19 need not always be transverse to the stripes.

FIG. 3*c* show the enlarged sectional view of the directing stripe 26 shown in FIG. 3 which is the rearmost stripe of the pattern or which lies close or adjacent to the lace opening of the shoe. In such stripes it can be preferred if the height of the stripe is greater or it increases obliquely in rearward direction or towards the lace opening. In case of the rearmost stripes or of a few further rear stripes this has the objective to prevent the ball from reaching the rear portions of the shoe which carry no pattern. In the example shown in FIG. 3 in which the directing stripes are nearly normal to the sole, this objective can be reached by making the rearmost stripe the highest and the height of the directing stripes proceeding in forward direction will gradually decrease. Close to the lace opening the increased height decreases the danger that the ball can hit the lace because such a collision might result in non-wanted ball reflections. If the stripe swells out of the base surface more than the lace, then the ball will more likely to reach the elevated surface of the directing stripe which has an increased grip and not the lace itself.

Reference is made now to FIG. 3*d* showing a detail of the zone 16. A specialty of the directing stripes 26 lies in that their lower ends extend over the associated lateral shooting zone and continue in downward direction to cover the outer edge of the sole of the shoe. When the ball accidentally reaches and contacts the edge of the sole then the grainy outer surface of the directing stripe 26 with the increased grip to the ball will direct the ball in the required direction and prevents the ball from being reflected in a random direction from the otherwise very hard edge of the sole. In case of using the pattern according to the invention it is advisable to use such design in case of all directing stripes which extend close to the meeting line of the upper and the sole and the direction of the directing stripes closes and angle with the plane of the sole, i.e. the stripes can be extended towards the sole.

Reference is made now to FIG. 4 which shows the top view of a sports shoe 10*b* made for a right foot. The inner side view of the same sports shoe 10*b* is shown in FIG. 5 and its outer side view in FIG. 6. The embodiment gives an example that the directing stripes and the directing channels between them can extend in a continuous transition between the zones. In the top view of FIG. 4 it can be seen that in the nose zone 14 directing stripes 28 are provided which extend in longitudinal direction and have nearly straight sides which are wider in the front and narrow in rearward direction. In this embodiment the directing channels 29 formed between the directing stripes 28 are also wider in the front part and narrow in rearward direction. Owing to such a design the directing stripe 28 falling in the central axis of the shoe extends along the direction x and from right and left from it the adjacent directing stripes spread out like a fan, and its extent is smaller in the direction towards the outer shooting zone 16 of the shoe than the spreading towards the other inner shooting zone 15.

The accurate shape of the directing stripes can be realized on the basis of considering the top and side views at the same time. In FIG. 5 it can be seen that the directing stripes 28 which appear straight in the top view follow the curved shape of the shoe with an arced curvature, and the lateral directing stripe 30 after the first curve extends in rearward direction substantially parallel to the direction x then starts to slope in downward direction. The decrease of the width of the directing stripes 28 also decreases in lateral positions and by the end they become parallel. The directing channels 31 between the directing stripes 30 are slightly wider in the front but in the region of the inner shooting zone 15 they have already constant width. Such a pattern will raise the path of the ball when the ball contacts the nose part at its inner region and at the inner shooting zone 15 a slightly raising effect prevails that does not decrease the height of the path. This shoe design assists additionally in spinning the ball at the front zone, therefore it can be used mainly as the shoe of rear player who have defensive roles.

FIG. 6 shows the outer shooting zone 16 of the shoe in which the characteristic directing stripes 32 extend uninterrupted through the nose zone 14 and the outer shooting zone 16, and their width decreases more definitely compared to the decrease in the inner side. The width of the directing channels 33 between the directing stripes 32 also decreases in rearward direction however; the extent of the decrease is much smaller. The directing stripes and channels follow the shape of the shoe with a slight arc and slope slightly in forward and outward directions. Such a design raises the path of the ball during shooting.

FIG. 7 shows a sports shoe 30*c* made for a right foot and provided with a very different pattern. In this embodiment the width of the directing stripes and the directing channels between them change more definitely and to a greater extent and the sides of the stripes are not only curved but they also have inflexion wherein the arcs start as concave and changes to become convex and vice versa. In front at the nose zone 14 we can see that the directing channels at the lower region are much wider and they definitely get curved and narrower in upward and inward directions. The directing channels get also narrower in upward and inward directions but the extent of narrowing is much slighter. The outer shooting zone 16 can be divided into two sections, namely to front section 16*a* and rear section 16*b*. In the front section 16*a* the directing stripes are very wide at the bottom and extend with a concave curvature (when seen from the front) towards the centre of the shoe in the directions z and y, and after about the half of their lengths they are much narrower and their curvature changes direction and takes a convex shape. The directing channels formed between them are parallel i.e. the change of inclination follows the change of the width. As the height of the shoe increases in rearward direction the radius of the curvature of the stripes follows that increase. The concave sections direct the ball mainly to a flatter path but where the curvature changes direction the raising directing effect prevails. Therefore the player can decide based on the angular position of the shoe that the ball should take a higher or a flatter path. The formation of the direction stripes is very interesting in the rear section 16*b*. Here the higher height of the side of the shoe makes possible that instead of a single directing stripe pairs of separate directing stripes be used, which constitute their continuation in an inverse manner which eliminates the need of making an inflexion. At the bottom portion the directing stripes 34 have forwardly directed concave arcs and their initial high width decreases suddenly to a great extent. Between them among the directing channels 35 the front channel widens in upward direction but the channels behind have rather respective constant widths. The rearmost directing stripe 34 has a definite arced forward inclination. The upper directing stripes 36 are slightly spaced from the directing stripes 34 and they widen in opposite i.e. upward direction which is rather steep. They are also strongly curved but their curvature is opposite to the curvature of the directing stripes 34 under them. The width of the directing channels 37 formed between them is constant or their changes are only slight compared to the high degree of widening of the directing stripes 36 in upward direction. The use of the embodiment described here must be learned by the player who uses them, whereas owing to the very definite curvatures such pattern has a much higher influence on the path of the ball. The lower directing stripes and those in the section 16*a* mainly raise the arced path of the ball, and opposite to such effects the rearward and upward arranged directing stripes 36 direct to ball to a flatter path. In the nose zone 14 the pattern directs the ball also in upward direction. This shoe provides great assistance to skilled players who get often into shooting positions. FIG. 7 does not show the design of the inner zones of the sports shoe 30*c*. This should be chosen among a number of possibilities in correspondence with the needs of the particular players.

Reference is made now to FIGS. 8 to 12 in which examples are shown to respective characteristic pattern shapes. The arrows indicated at these figures show towards the forward direction.

Figure 8:
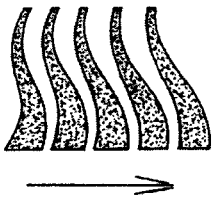

The directing stripes shown in FIG. 8 get narrower in upward direction whereas their curvature changes direction in a central height region they get concave from an initial convex shape. It is characteristic to this pattern that the directing channels get narrower to a smaller extent but in inverse direction i.e. from above to downward. In order that the inclination of the pattern can remain unchanged, the width of the directing channels changes in smaller extent in rearward direction. With the indicated forward direction this pattern is intended primarily to a forward player, while if the direction is reversed, the same pattern is good for a defense player.

Figure 9:
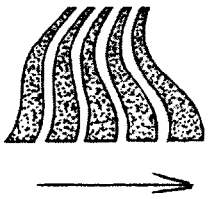

The shape of the directing stripes shown in FIG. 9 is substantially the same as shown in the previous FIG. 8 and the substantial difference lies in that here the width of the directing channels is constant. This will have the result that the angle of inclination of subsequent directing stripes continuously changes and the direction of the radius of the central arc section also changes that has an influence on the direction how the ball is diverted. With the indicated direction the pattern is good for an attacking forward player. If the pattern is applied in reverse direction then same will be good for a defense position.

Figure 10:
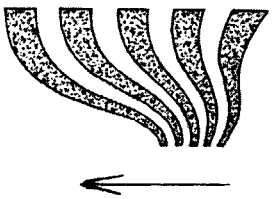

In the pattern shown in FIG. 10 the shape of the directing stripes corresponds basically to that shown in FIG. 8 but compared thereto it is opposite by 180° i.e. the directing stripes are the narrowest at their bottom and widest at their top. The width of the directing channels changes however oppositely compared to FIG. 8, the channels are the widest where the stripes are the widest. From this it follows that the position and angle of inclination of the subsequent directing stripes change significantly. The rearmost directing stripe (which is at the right end of the drawing) has a slightly backward inclination, but the adjacent subsequent directing stripes incline in forward direction and finally the leftmost stripe starts almost in horizontal direction and its inflexion is more definite. This pattern is also intended for a forward player. This pattern can also be used when applied in reverse direction, and then it is good for a defense player.

Figure 11:
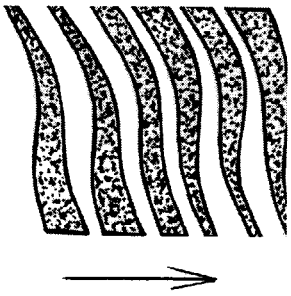

FIG. 11 shows a rather interesting pattern in which the stripes seemingly compensate each other. The direction of change of the width of the subsequent directing stripes slowly get reversed i.e. the leftmost stripe is wide at the bottom and narrow at the top, then the third stripe has substantially parallel sides and right form it the stripes get narrow at the bottom and wide at the top. The circumstance that the average inclination of the stripes does not change substantially is the consequence of the fact that the width of the directing channels changes oppositely to the change of the width of the stripes. With the indicated direction the pattern is intended primarily to a midfield player who has mostly defense tasks. If the direction is reversed, the pattern is good for a midfield player who has more attacking (shooting) role.

Figure 12:
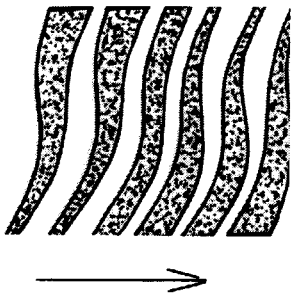

FIG. 12 shows a pattern similar to that on FIG. 11 but here the pattern is turned by 180° with respect to it. The initial angle of inclination is different, i.e. in FIG. 11 the lower arcs incline rather in rearward direction and the curves of the upper arcs direct the ball rather in upward direction, and in case of the pattern of FIG. 12 the convex arc at the bottom is inclined in forward direction and the concave section above it has also rather a forward inclination i.e. they try to divert the ball into a flatter path. This pattern is designed mostly to a forward, attacking player. If the same pattern is reversed, the shoe is intended for a midfield player mostly in defense position.

The examples provided have shown a number of variations of the directing stripes and the directing channels formed between them. The smallest width of the directing stripes is around 3 mm and their greatest width is between about 15 and 20 mm, and the directing channels are also at least about 3 mm wide and their width does not exceed 15 to 20 mm, however channels narrower than this range can also be used. The range defined here provides a substantially great variation possibility for the designer concerning the shape of the directing stripes and directing channels. The limits described here are not limiting in any case because values higher and smaller than suggested can also be chosen, however, the associated effects will be not as high.

It has been shown in the foregoing that the pattern according to the invention can be completely different in the respective zones, and even within regions in the same zone, whereas there is a possibility of using patterns that provide a continuous transition between the adjacent zones.

Of course, the use of sports shoes provided with the patterns according to the invention should be exercised in a thorough way. The exercise and even the gaming itself can be improved if the respective different zones or in special parts of the zones the directing isles are made in different colours. It such a case the task of the coach will be simpler because instead of long explanations it is easier for him to give only the name of the colour in his training instructions in which he plans to suggest the receipt or the shooting of the ball. The players will understand more easily by hearing the name of a colour that in any given playing situation how i.e. with what zone of the shoe they should receive and kick the ball.

There are several possibilities for placing the directing stripes on the shoe surface. Before the placement of the directing stripes it is advisable to cover the shoe surface at positions where the pattern should not be made by masks. To this end narrow masking tapes can be used which are placed along the planned directing channels. Following the masking step the uncovered areas left between the masks can be covered by directing stripes that have good adhesion properties.

One of the previously referred ways to provide the directing stripes is the application of the grains. Such a solution can be made preferably by coating in a thin layer the non masked surfaces of the basic surface 17 of the shoe by an appropriate adhesive and a first layer consisting of rubber granules is applied thereon wherein the size of the granules are between 0.1 mm and 0.3 mm or between 0.1 mm and 0.4 mm. This can be made in such a way that from a mix of rubber granules by means of a sieve first those parts are selected which are smaller than the upper limit of the mentioned size range then by using a second sieve those particles are removed which are smaller than the lower limit of the range. The suggested size range has good adhesion to the planar base surface and the granules are not completely immersed in the thin adhesive layer provided, their outer parts will not be covered by the adhesive. On the top of such a first layer it is advisable to apply a second layer consisting of rubber granules, but here larger granules can be used with a size distribution between about 0.3 and 0.6 mm or 0.3 to 0.8 mm. Prior to the application of the second layer the irregular outer surface of the first layer is covered by a thin layer of adhesive and the mix of larger granules is applied thereon. The bottom of the larger granules extend into the valleys and recesses formed between the granules of the first layer and will contact and adhere along a larger surface to the granules underneath but their outer surfaces remain uncoated. By such a method a coating can be obtained in which the directing stripes will have the required thickness (height). If a greater thickness is required one or more further similar layers can be applied in the same way.

A further way of making the directing stripes is the use of sheets having self adhesive bottom surfaces wherein their outer surfaces are coated by the aforementioned single or multiple layers of rubber granules.

The actual use can be realized in several variations because templates can be prepared that enable the coverage of a whole zone. Such a template should have a flexibility to accurately fit to the curved shoe surface wherein the bottom of the directing stripes is covered by a self adhesive layer and the fields in between them can be removed easily, i.e. after the protective foil covering the bottom of the template is removed and the concerned zone is covered by the template then only the directing stripes will remain adhered to the shoe surface and at the locations of the directing channels the basic shoe surface remains uncovered.

An alternative possibility is to prepare separate self adhering directing stripes e.g. in sets and to provide appropriate positioning plans, templates to the users. In case of experienced players the preparation of separate self adhesive directing stripes can be sufficient so that the player can arrange them on his shoes according to his personal preferences.

The possibility of the individual application of the pattern has been mentioned only as a preferred option because the pattern according to the invention can be made according to the expected (and experienced) needs of frequently used player's positions, because different patterns are needed for a forward player, a rear guard or a midfield player, or those preferring the right or left sides of the playground, or who prefer different zones. A rather interesting possibility can be that such sports shoes would be sold not in exactly fitting pairs and the players could make their choices between left and rights shoes in the same size but having different patterns.

The pattern according to the invention can be combined with other preferred patterns i.e. it can be sufficient if only a single or only a few zones are provided with the pattern according to the invention and on the remaining surface areas conventional or different preferred designs are used.

Based on the foregoing it can be understood that the pattern using the directing stripes according to the invention can be made in a high number of variations matching to the playing styles and needs of the individual players.

The invention claimed is:

1. A sports shoe with an array of elongated ball directing stripes facilitating ball handling, comprising a shoe upper defining a basic surface on the outside of said shoe upper and a sole secured to said shoe upper, wherein the basic surface of the shoe upper comprises a plurality of shooting zones, said shooting zones comprising at least a nose zone (14), an inner shooting zone (15) and an outer shooting zone (16), and wherein at least one of said shooting zones (14, 15, 16) supports a plurality of said ball directing stripes (20), each of said ball directing stripes having a length, and each having a respective width measured normal to said length wherein said length being several times longer than said width, said ball directing stripes (20) being arranged side-by-side beside and being spaced from each other, said ball directing stripes extend out from the surface of the shoe upper, said ball directing stripes extending from said basic surface of the shoe upper to engage a ball, the ball directing stripes (20) defining respective elevated outer surfaces (18), displaced from said basic surface and effectuating increased gripping of the ball compared to the gripping action of the basic surface (17) without said ball directing stripes, said ball directing stripes each defining two edges at their sides, wherein the spaces between said ball directing stripes (20) constitute respective exposed ball directing channels (21) that have respective widths normal to the length of said ball directing stripes defining them, wherein the ball directing channels formed between the ball directing stripes act as spatial tracks whereby a ball impacting said spatial tracks is directed toward following the direction of the contacted exposed ball directing channel, and said at least one shooting zone comprises a group of at least four ball directing stripes (20), said at least four ball directing stripes defining at least three ball directing channels (21) between the ball directing stripes, and in said group the width of the ball directing stripes and/or the width of each ball directing channel continuously changes along its length, wherein the width of the ball directing stripes is at least 3 mm and at most 20 mm and their height is at least 0.4 mm, and the width of said ball directing channels is at most 20 mm.

2. The sports shoe as claimed in claim 1, wherein the change of the width of the ball directing stripes (20) in a group takes place in one direction along their length.

3. The sports shoe as claimed in claim 1, wherein the width of the ball directing channels (21) in a group is constant.

4. The sports shoe as claimed in claim 1, wherein the width of the directing channels (21) changes in the same direction as the width of the ball directing stripes (20) defining them.

5. The sports shoe as claimed in claim 1, wherein the width of the ball directing channels (21) changes along its length in the opposite direction as the change in width of the ball directing stripes (20) defining them.

6. The sports shoe as claimed in any of claim 1, wherein the edges of the ball directing stripes (20) are curved in the space and when spread in a plane they are arced in a direction.

7. The sports shoe as claimed in any of claim 1, wherein the edges of the ball directing stripes (20) have bidirectional curvature with an inflexion in a central part.

8. The sports shoe as claimed in claim 1, wherein in a group the direction of the change of the width of the ball directing stripes (20) gets reversed in a central region.

9. The sports shoe as claimed in claim 8, wherein the change of the width of the ball directing channels (21) gets also reversed but in opposite direction than the change of the width of the ball directing stripes (20).

10. The sports shoe as claimed in claim 1, wherein at least one of said groups constituted by said ball directing stripes and said ball directing channels between them extend through a plurality of said zones.

11. The sports shoe as claimed in claim 1, wherein the outer surface (18) of the ball directing stripes comprises uncoated particulates of a flexible, resilient material wherein the average particulate size is between about 0.4 and 1 mm.

12. The sports shoe as claimed in claim 1, wherein at least few of said ball directing stripes comprises a ribbing on its outer surface (18).

13. The sports shoe as claimed in claim 1, comprising ball directing stripes that extend till the edge of the sole and cover at least a portion of the edge.

14. The sports shoe as claimed in claim 1, comprising ball directing stripes in the rear portion of the shoe, wherein the height of the stripes increases in rearward direction from a front end to a rear end.

15. The sports shoe as claimed in claim 1, wherein the shoe comprises a lace opening, and the height of at least a few of said ball directing stripes that extend close to the lace opening has height increasing in the direction of said lace opening.

16. The sports shoe as claimed in claim 1, wherein each ball directing stripe has an upper surfaces roughly evenly displaced from the basic surface underneath.

17. The sports shoe as claimed in claim 1, wherein the basic surface has a length and a width, and the ball directing stripes have upper surfaces which are parallel to the length of the basic surface.

18. The sports shoe as claimed in claim 1, wherein the channels are open ended as defined by a terminal end of said elongated ball directing stripes.

19. The sports shoe as claimed in claim 1, wherein the width of the ball directing stripe is larger than the height of the ball directing stripe.

20. The sports shoe as claimed in claim 1, wherein the directing stripes have a grainy structure.

* * * * *